US009025984B2

(12) United States Patent
Soda et al.

(10) Patent No.: US 9,025,984 B2
(45) **Date of Patent: *May 5, 2015**

(54) IMAGE FORMING APPARATUS CAPABLE OF STABLY DETECTING TEMPERATURE OF FIXING DEVICE REGARDLESS OF ORIENTATION OF THE IMAGE FORMING APPARATUS

(71) Applicant: Konica Minolta, Inc., Chiyoda-ku (JP)

(72) Inventors: Koji Soda, Toyokawa (JP); Junichi Tanimoto, Toyokawa (JP); Masashi Kawai, Toyohashi (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 51 days.

This patent is subject to a terminal disclaimer.

(21) Appl. No.: 13/874,526

(22) Filed: May 1, 2013

(65) Prior Publication Data

US 2013/0302056 A1 Nov. 14, 2013

(30) Foreign Application Priority Data

May 11, 2012 (JP) ..... 2012-109360

(51) Int. Cl.
*G03G 15/20* (2006.01)
*G03G 21/16* (2006.01)

(52) U.S. Cl.
CPC ..... *G03G 15/2078* (2013.01); *G03G 21/1604* (2013.01); *G03G 2215/00012* (2013.01); *G03G 15/2039* (2013.01)

(58) Field of Classification Search
CPC ..... G03G 15/2039; G03G 15/2078; G03G 21/1604; G03G 21/1609; G03G 2215/00012; G03G 2215/00008
USPC ..... 399/69, 107, 110, 122, 320, 330; 219/216
See application file for complete search history.

(56) References Cited

U.S. PATENT DOCUMENTS 5,512,975 A 4/1996 Kitsu et al.
5,528,344 A 6/1996 Yamaguchi et al.

(Continued)

FOREIGN PATENT DOCUMENTS

JP 04-323125 A 11/1992
JP 06-320836 A 11/1994

(Continued)

OTHER PUBLICATIONS

Japanese Office Action (Notification of Reasons for Refusal) dated Jul. 15, 2014, issued by the Japanese Patent Office in corresponding Japanese Patent Application No. 2012-109360 and English language translation. (4 pages).

(Continued)

*Primary Examiner* — Robert Beatty
(74) *Attorney, Agent, or Firm* — Buchanan Ingersoll & Rooney PC

(57) ABSTRACT

An image forming apparatus orientatable in either a first position or a second position, the second position being different from the first position in inclination with respect to a horizontal plane, comprising: a fixing device including a heating roller and a pressurizing member, pressing the pressurizing member against a surface of the heating roller to form a fixing nip, and thermally fixing a toner image on a recording sheet passing through the fixing nip; at least one temperature detector detecting surface temperature of the heating roller without contact with the surface; a heater heating the heating roller; a controller controlling the heater according to the surface temperature, thereby controlling the surface temperature; and a switcher switching a detection point of the temperature detector between a first and a second detection point according to whether the image forming apparatus is in the first or the second position.

4 Claims, 8 Drawing Sheets

(56) References Cited

U.S. PATENT DOCUMENTS

| | | | | |
|---|---|---|---|---|
| 5,697,016 | A * | 12/1997 | Kitsu et al. | 399/69 |
| 2009/0208237 | A1 | 8/2009 | Yasuda | |
| 2011/0052236 | A1 | 3/2011 | Matsuno | |
| 2012/0082474 | A1 | 4/2012 | Otsuka | |
| 2013/0302055 | A1 * | 11/2013 | Soda et al. | 399/69 |

FOREIGN PATENT DOCUMENTS

| | | | |
|---|---|---|---|
| JP | 7-152272 | A | 6/1995 |
| JP | 8-101578 | A | 4/1996 |
| JP | 8-314333 | A | 11/1996 |
| JP | 2006-184364 | A | 7/2006 |
| JP | 2007-326222 | A | 12/2007 |
| JP | 2009-180917 | A | 8/2009 |
| JP | 2011-048190 | A | 3/2011 |
| JP | 2012-78563 | A | 4/2012 |

OTHER PUBLICATIONS

Office Action (Decision to Grant a Patent) issued on Jan. 6, 2015, by the Japan Patent Office in corresponding Japanese Patent Application No. 2012-109360, and an English Translation of the Office Action. (3 pages).

* cited by examiner

IMAGE FORMING APPARATUS CAPABLE OF STABLY DETECTING TEMPERATURE OF FIXING DEVICE REGARDLESS OF ORIENTATION OF THE IMAGE FORMING APPARATUS

This application is based on application No. 2012-109360 filed in Japan, the content of which is hereby incorporated by reference.

BACKGROUND OF THE INVENTION (1) Field of the Invention

The present invention relates to an image forming apparatus that is orientatable in different positions, and in particular to a technology of detecting the temperature inside a fixing device of the image forming apparatus.

(2) Description of Related Art

When image forming apparatuses such as printers are used, they are usually orientated in the horizontal position so that the surface of the paper feed tray, on which recording sheets are loaded, will be substantially horizontal. This is because such a position prevents the recording sheets on the paper feed tray from bending, and realizes smooth paper feeding.

However, when used in for example an ordinary house with not very large space, it is convenient if the image forming apparatus can be placed in its upright position.

Recently, considering such demand, there have been proposals of an image forming apparatus that can be used in either the horizontal position or the upright position according to the size of the installation space (e.g. Japanese Patent Application Publication No. 8-314333).

However, particularly when an electrophotographic image forming apparatus is used in the upright position, there are possibilities that the temperatures of the heating rollers of the fixing device such as a fixing roller cannot be precisely controlled, for the following reasons.

Generally, the temperature of the circumferential surface of the heating roller is detected with a temperature sensor such as a thermistor located near the circumferential surface, without contact with the circumferential surface so as to avoid damaging the surface. On and off of the heating roller is controlled based on the detected temperature so that the temperature of the circumferential surface of the heating roller will be kept at a predetermined level.

However, it should be noted here that such a non-contact temperature sensor is generally configured to detect the temperature of the conductive heat due to the natural convection of the air existing between the heating roller and the temperature sensor. Therefore, when the orientation of the image forming apparatus is changed and accordingly the relative position of the temperature sensor with respect to the heating roller is changed, the convection of the air existing between the heating roller and the temperature sensor might change. Such a change causes a difference in the result of the detection by the temperature sensor.

Therefore, even if the image forming apparatus is designed to appropriately control the temperature of the heating roller based on the results of the detection by the temperature sensor when the image forming apparatus is in the horizontal position, there is a problem that the temperature adjustment does not work properly when the image forming apparatus is in the upright position.

SUMMARY OF THE INVENTION

Considering the above-described problem, the present invention aims to provide an image forming apparatus that is orientatable in different positions and that is capable of precisely detecting the surface temperature of the heating roller regardless of the orientation and thereby performing appropriate temperature adjustment.

To achieve the aim, one aspect of the present invention provides an image forming apparatus that is orientatable in either a first position or a second position, the second position being different from the first position in inclination with respect to a horizontal plane, comprising: a fixing device that includes a heating roller and a pressurizing member, presses the pressurizing member against a surface of the heating roller to form a fixing nip, and thermally fixes a toner image formed on a recording sheet passing through the fixing nip; at least one temperature detector that detects temperature of the surface of the heating roller without contact with the surface; a heater that heats the heating roller; a controller that controls the heater according to the temperature detected by the at least one temperature detector, and thereby controls the temperature of the surface of the heating roller; and a switcher that switches a detection point of the at least one temperature detector between a first detection point and a second detection point according to whether the image forming apparatus is in the first position or in the second position.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF PREFERRED EMBODIMENTS

(1) Embodiment 1

The following describes an image forming apparatus pertaining to Embodiment 1 of the present invention, with reference to the drawings.

(1-1) Structure of Image Forming Apparatus

Figure 1:
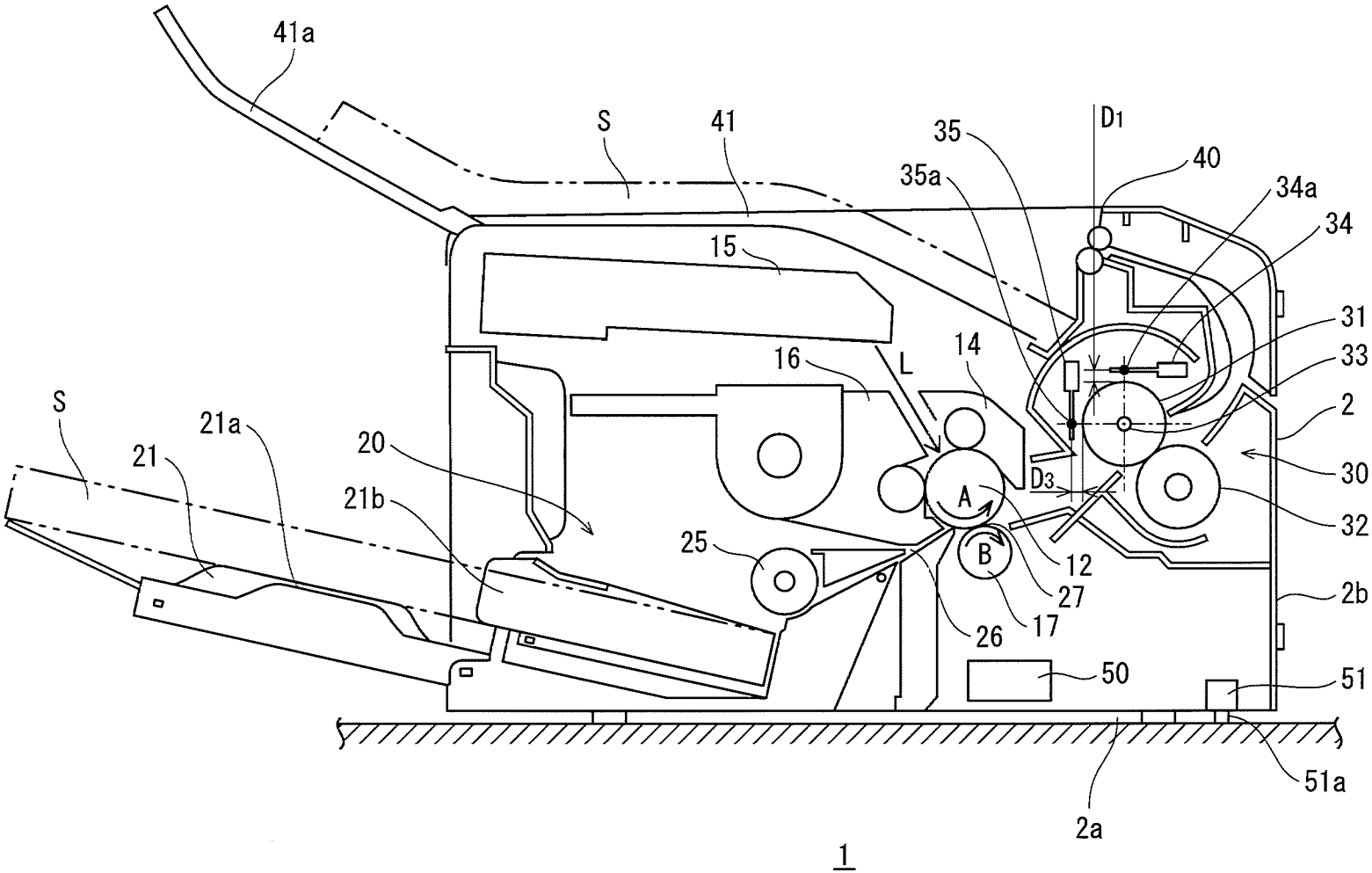
FIG. 1 is a schematic cross-sectional view of an image forming apparatus pertaining to Embodiment 1 of the present invention, orientated in the horizontal position.

FIG. 1 a schematic cross-sectional view for explaining the structure of a monochrome printer as an example of an image forming apparatus pertaining to Embodiment 1 of the present invention.

The printer 1 has a casing 2 having an almost rectangular parallelepiped shape. The printer 1 is orientatable in either "the horizontal position" in which the largest face 2*a* of the casing 2 is in contact with the installation surface and the paper feed tray 21 is positioned almost horizontally, or "the upright position" in which a face 2*b* of the casing 2, which is smaller than and perpendicular to the face 2*a*, is in contact with the installation surface. FIG. 1 shows the printer 1 in the horizontal position.

The user usually installs the printer 1 in the horizontal position, and selects the upright position when the space for placing the printer 1 is limited.

The printer 1 has a cylindrical photosensitive drum 12 which is rotatable in the direction indicated by the arrow A.

Around the photosensitive drum 12, a charger 14, an optical unit 15, a developer 16 and a transfer roller 17, which are used for forming a toner image on a recording sheet by an electrophotographic method, are provided in the stated order along the rotation direction of the photosensitive drum 12 (i.e. in the counterclockwise direction shown in the drawing).

In the printer 1, the controller 50 converts image data received from an external device to a drive signal suitable for a laser diode, and drives the laser diode of the optical unit 15 by using the drive signal.

Thus, the optical unit 15 irradiates the surface of the photosensitive drum 12 with a laser beam L corresponding to the image data.

The surface of the photosensitive drum 12 is charged in advance at a predetermined potential by the charger 14. When the surface of the photosensitive drum 12 is irradiated with the laser beam L from the optical unit 15, an electrostatic latent image is formed on the surface of the photosensitive drum 12. The electrostatic latent image is developed by the developer 16 using toner, and thus a toner image is formed.

A paper feeder 20 is provided below the photosensitive drum 12. The paper feeder 20 includes a paper feed tray 21, a pickup roller 25, and so on. The paper feed tray 21 houses a stack of recording sheets S, such as sheets of paper or OHP sheets.

The pickup roller 25 picks up the uppermost sheet one by one from among the recording sheets S in the paper feed tray 21, and conveys the sheet onto the transport path 26 running toward the photosensitive drum 12.

A lift-up plate 22*a* of the paper feed tray 21 is moved upward or downward by a driving mechanism such as a cam mechanism (not illustrated). The lift-up plate 22*a* is moved upward when the recording sheets S are transported onto the transport path 26, so that the uppermost recording sheet is pressed against the pickup roller 25.

A transfer roller 17, which is rotated in the direction indicated by the arrow B, is disposed to be pressed against the circumferential surface of the photosensitive drum 12, and thus a transfer nip 27 is formed. The recording sheet S is transported to the transfer nip 27 through the transport path 26.

While the recording sheet S is passing through the transfer nip 27, the toner image carried on the photosensitive drum 12 is transferred to the recording sheet S due to the electric field generated by transfer voltage applied to the transfer roller 17.

After the toner image is transferred onto the recording sheet S, the surface of the photosensitive drum 12 is cleaned up by a cleaning blade or the like (not illustrated).

Meanwhile, the recording sheet S on which the toner image has been transferred is transported to the fixing unit 30.

The fixing unit 30 includes a fixing roller 31 and a pressure roller 32 disposed in parallel, and a fixing nip is formed between the fixing roller 31 and the pressure roller 32.

The fixing roller 31 has a built-in heater (halogen lamp) 33 whose temperature is under the control of the controller 50. The heater 33 applies heat to the fixing roller 31.

The fixing unit 30 is provided also with a first temperature sensor 34 and a second temperature sensor 35 located in the middle area of the fixing roller 31 in the longitudinal direction (i.e. the depth direction of the sheet of the drawing). The first temperature sensor 34 is used for temperature adjustment when the printer 1 is orientated in the horizontal position, and the second temperature sensor 35 is used for temperature adjustment when the printer 1 is orientated in the upright position. The first temperature sensor 34 and the second temperature sensor 35 are located at different points with respect to the circumferential direction of the fixing roller 31 so as not to be in contact with the fixing roller 31. The positional difference mentioned above will be discussed later.

The first temperature sensor 34 and the second temperature sensor 35 are made up from relatively cheap thermal sensors such as thermistors or thermocouples, and specifically NTC thermistors are adopted in the present embodiment.

While the recording sheet S is passing through the fixing nip, the fixing roller 31 applies predetermined amounts of heat and pressure to the unfixed toner image transferred on the recording sheet S, so that the image is fixed onto the recording sheet S.

After passing through the fixing nip, the recording sheet S is transported to the ejection roller 40 by the fixing roller 31 and the pressure roller 32, and is ejected onto the output tray 41 by the ejection roller 40.

Note that a detachable extension tray 41*a* is provided downstream of the output tray 41. The extension tray 41*a* prevents the recording sheet S from hanging down when the recording sheet S is large in size.

The printer 1 is provided also with an orientation detector 51 that detects the orientation of the printer 1.

In the present embodiment, a push switch is provided as the orientation detector 51 in a face 2*a* of the casing 2, which is the bottom surface of the casing 2 when the printer 1 is orientated in the horizontal position. When the printer 1 is orientated in the horizontal position, an actuator 51*a* of the orientation detector 51, which protrudes outward from the face 2*a*, is pressed by the installation surface. Detecting such a movement of the actuator 51*a*, the orientation detector 51 outputs to the controller 50 a signal indicating that the printer 1 is in the horizontal position.

The controller 50 totally controls the components of the printer 1, and thereby realizes smooth execution of print jobs. As part of such control, the controller 50 selects the first temperature sensor 34 or the second temperature sensor 35 whichever is appropriate as a temperature sensor used for the temperature adjustment according to the orientation of the printer 1. While measuring the surface temperature of the fixing roller, the controller 50 controls ON and OFF of the heater 33 to keep the temperature at a target level. Further discussion of this temperature adjustment will be given later.

Figure 2:
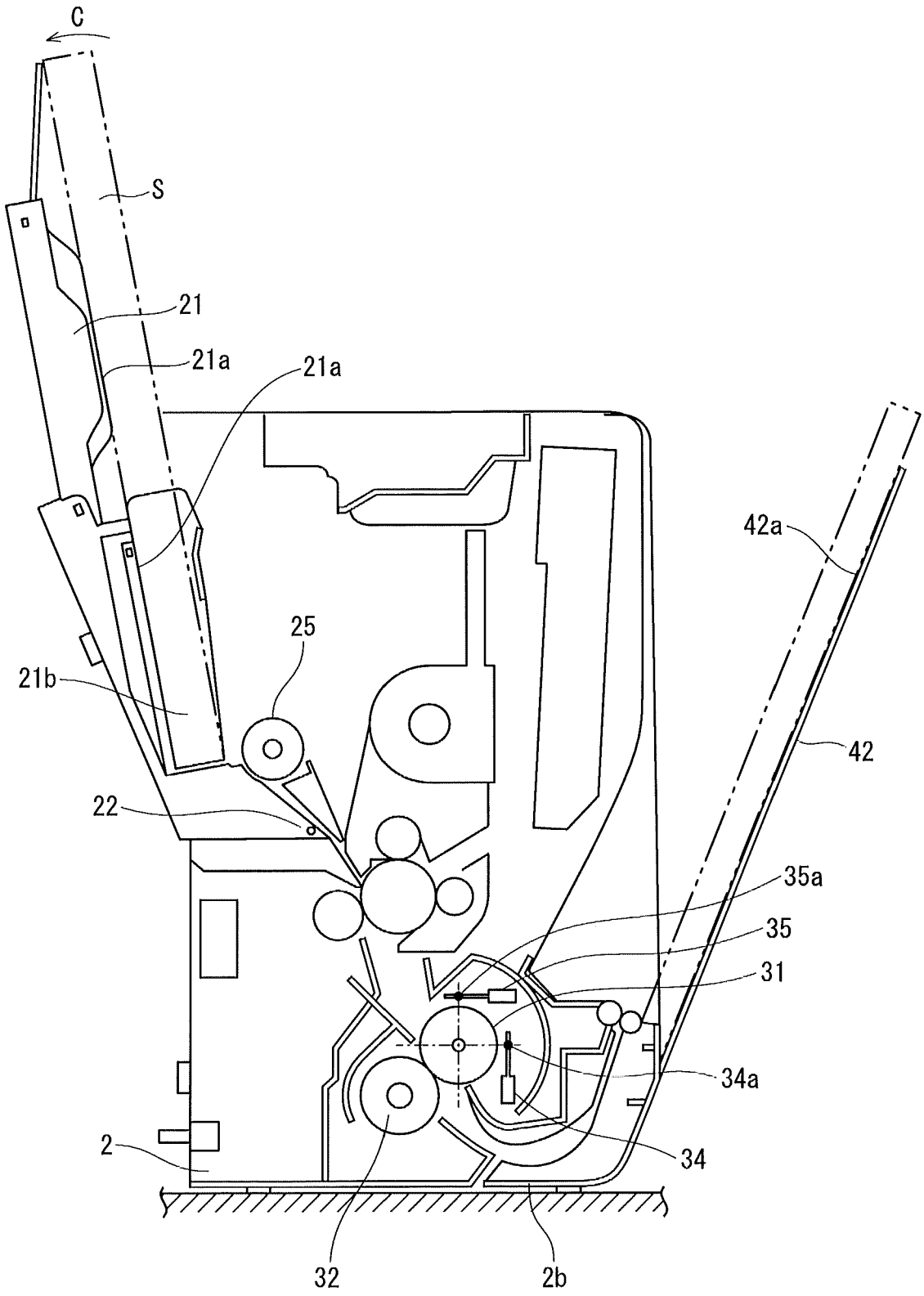
FIG. 2 is a schematic cross-sectional view of the image forming apparatus orientated in the upright position.

FIG. 2 is a schematic cross-sectional view of the printer 1 orientated in the upright position, in which the face 2*b* of the casing 2 is in contact with the installation surface.

When orientating the printer 1 in the upright position, the user rotates the paper feed tray 21 about the shaft 22 in the direction indicated by the arrow C.

Consequently, the surface 21*a* of the paper feed tray 21, on which the recording sheets S are to be loaded, slightly inclines with respect to the vertical direction so that the recording sheets S can be mounted so as to lean against the paper feed tray 21.

The paper feed tray 21 is provided also with a pair of guide plates 21*b* at both ends of the paper feed tray 21 in the widthwise direction (i.e. the depth direction of the sheet of the drawing). The pair of guide plates 21*b* guide the edges in the widthwise direction of the recording sheets S, and simultaneously, prevent the recording sheets S from falling from the paper feed tray 21 by filing the gap formed between the casing 2 and the paper feed tray 21 when the printer 1 is orientated in the upright position.

Here, the pickup roller 25 and the drive source (not illustrated) connected to the pickup roller 25 are configured to swing together with the paper feed tray 21. Therefore, the pickup roller 25 can be brought into contact with the uppermost sheet of the recording sheets S regardless of the orientation of the printer 1.

When orientating the printer 1 in the upright position, the user detaches the extension tray 41*a* (c.f. FIG. 1) from the casing 2, and attaches another extension tray 42 instead.

Thus, a surface 42*a*, which slightly inclines with respect to the vertical direction, is formed. Therefore, the ejected recording sheets S can be stacked on the surface 42*a*. If the extension tray 41*a* is designed to be usable when the printer 1 is in the upright position as well, it is unnecessary to provide the extension tray 42, and the cost of the extension tray 42 can be reduced.

The first temperature sensor 34 and the second temperature sensor 35 provided in the present embodiment respectively have portions 34*a* and 35*b* with a high thermal-detection sensitivity (hereinafter referred to as the "heat sensitive portions 34*a* and 35*b*"). When the printer 1 is in the horizontal position, the heat sensitive portion 34*a* of the first temperature sensor 34 is located above the widthwise midpoint of the fixing roller 31 on the vertical line passing through the axial center of the fixing roller 31 (See FIG. 1. Such a position is hereinafter simply referred to as the position "right above the midpoint of the roller").

The heat sensitive portion 35*a* of the second temperature sensor 35, as shown in FIG. 2, is located right above the midpoint of the roller when the printer 1 is in the upright position.

The minimum distance D1 between the surface of the fixing roller 31 and the heat sensitive portion 34*a* and the minimum distance D2 between the surface of the fixing roller 31 and the heat sensitive portion 35*a* (see FIG. 1) are both set to be 2.3 mm±0.3 mm.

Such a value of D1 and D2 is determined so that the heat sensitive portion 34*a* and the heat sensitive portion 35*a* can precisely detect the surface temperature of the fixing roller 31 while avoiding damaging the surface of the fixing roller 31 by contacting with the surface due to a positional error that could occur in assembly of the printer 1.

(1-2) Structure of Controller

Figure 3:
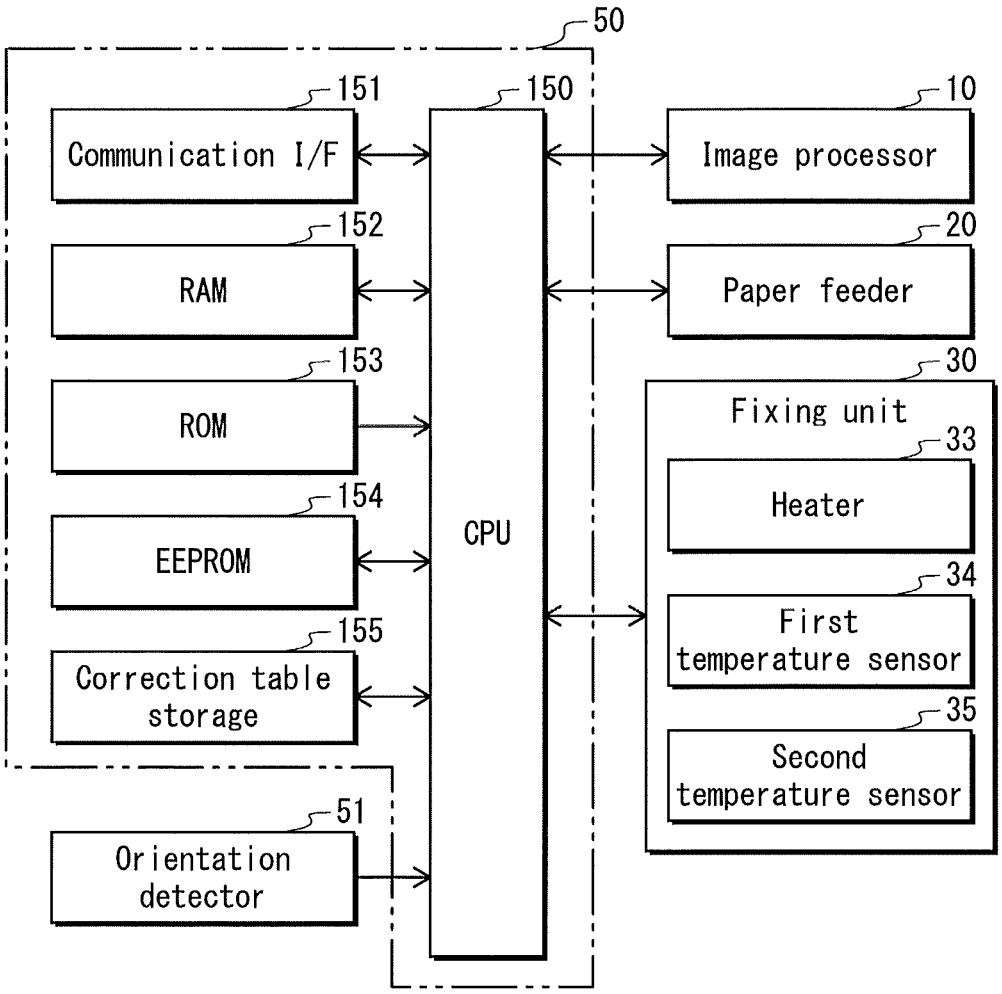
FIG. 3 is a block diagram showing a controller of the image forming apparatus and components under the control of the controller.

FIG. 3 shows the structure of the controller 50 of the printer 1 and the relationship with primary components under the control of the controller 50.

The controller 50 includes, as primary components, a CPU 150, a communication interface (I/F) 151, a RAM 152, a ROM 153, an EEPROM 154 and a correction table storage 155.

The communication I/F 151 is an interface for connecting to the LAN, such as a LAN card and a LAN board.

The RAM (Random Access Memory) 152 is a volatile memory, and serves as a work area when the CPU 150 executes a program.

The ROM (Read Only Memory) 153 stores, for example, a control program used for performing control related to the execution of printing.

The EEPROM (Electronically Erasable and Programmable Read Only Memory) 154 is non-volatile memory, and serves as a data area used by the CPU 150.

The correction table storage 155 is made up from an EEPROM, and stores a correction table used for the temperature adjustment which will be discussed later.

The CPU (Central Processing Unit) 150 performs warming-up or printing by executing a control program stored in the ROM 153.

The CPU 150 turns ON or OFF the heater 33 provided in the fixing roller 31 according to the signals output from the orientation detector 51, the first temperature sensor 34, and the second temperature sensor 35 of the fixing unit 30, and thereby performs the following temperature adjustment for adjusting the temperature of the fixing roller 31 to be at a target level.

(1-3) Temperature Adjustment

Figure 4:
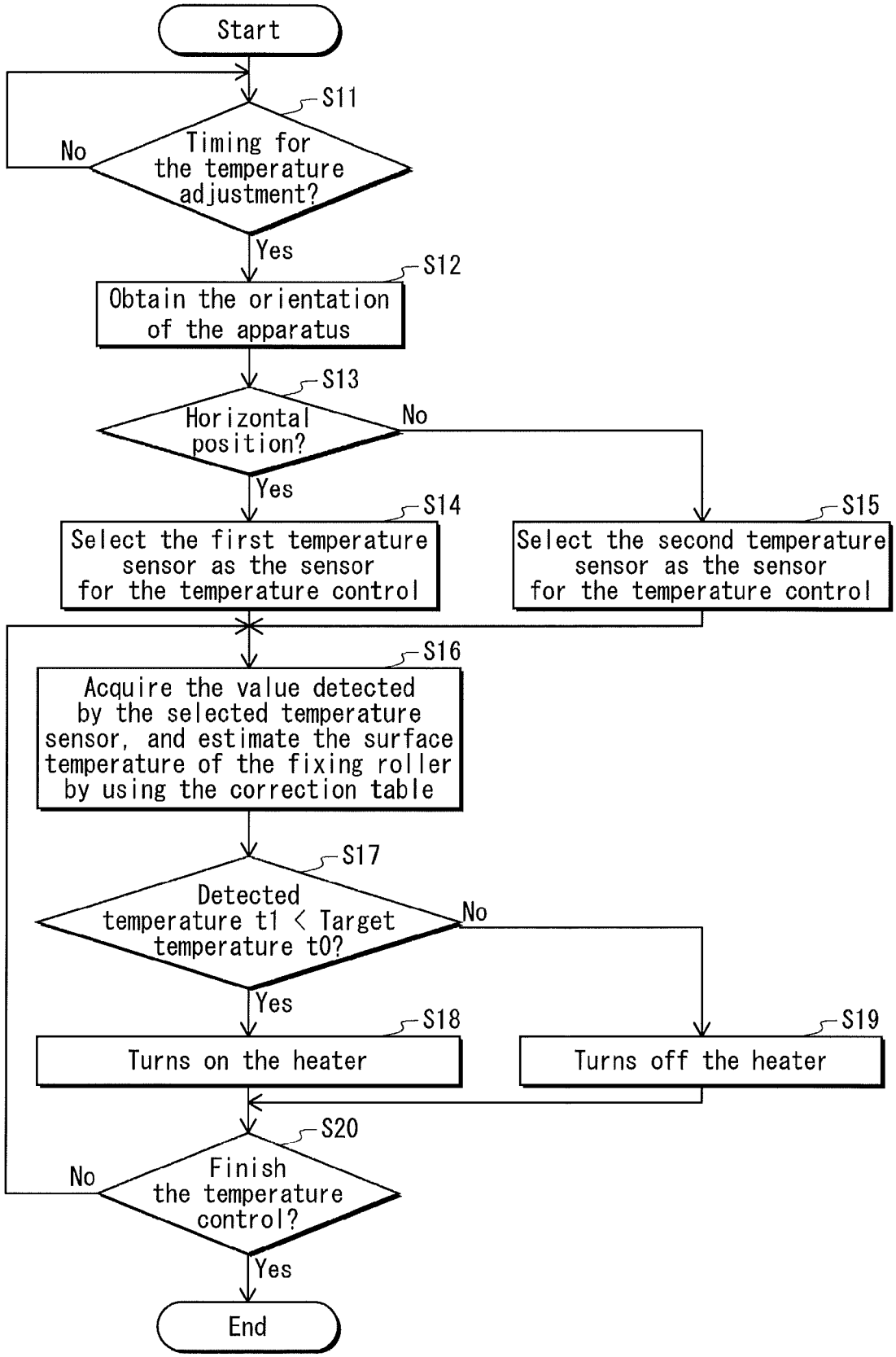
FIG. 4 is a flowchart showing processing procedures for temperature adjustment performed by the controller.

The following describes the procedures performed by the controller 50 pertaining to Embodiment 1 to control the temperature of the fixing roller 31, with reference to the flowchart shown in FIG. 4.

The CPU 150 waits until the timing for adjusting the temperature of the fixing roller 31 (Step S11: NO). The CPU 150 determines to start the temperature adjustment, for example immediately after the printer 1 is powered on or when receiving a print job (Step S11: YES), and obtains an output signal from the orientation detector 51 (FIG. 1) as information indicating the current orientation of the printer 1 (Step S12).

When determining that the printer 1 is in the horizontal position based on the information (Step S13: YES), the CPU selects, from the first temperature sensor 34 and the second temperature sensor 35, the first temperature sensor 34 as the temperature sensor used for the temperature adjustment (Step S14).

Then, the CPU 150 estimates the surface temperature of the fixing roller 31 by using the detection value of the selected first temperature sensor 34 and the correction table stored in the correction table storage 155 (Step S16).

The first temperature sensor 34 is a non-contact sensor as described above, and hence its detection value is not exactly the same as the actual surface temperature of the fixing roller 31. Considering this, the actual surface temperature of the fixing roller 31 and the detection value of the first temperature sensor 34 are obtained in advance by experiment under the condition that the printer 1 is in the horizontal position, and a correction coefficient is calculated for each detection value obtained by the first temperature sensor 34. Here, the correction coefficient is used for converting the detection values to the actual surface temperatures of the fixing roller 31. Thus, a correction table associating the detection values of the first temperature sensor 34 with the correction coefficients is created, and the correction table storage 155 stores such a table.

When the surface temperature t1 of the fixing roller 31 thus obtained is lower than the target temperature t0 (Step S17: YES), the CPU 150 turns ON the heater 33 (Step S16) to apply heat to the fixing roller 31. When the surface temperature t1 is equal to or higher than the target temperature t0 (Step S17: NO), the CPU 150 turns OFF the heater 33 (Step S19).

Then, the CPU 150 determines whether to finish the temperature adjustment (Step S20). The CPU 150 determines to finish the temperature adjustment, for example immediately after a print job is completed, or after a predetermined interval from the completion of a print job.

When determining not to finish the temperature adjustment (Step S20: NO), the CPU 150 repeats the above-described Steps S16 through S19.

When determining to finish the temperature adjustment (Step S20: YES), the CPU 150 checks the power state of the heater 33 at the time of the determination. When the heater 33 is ON, the CPU 150 turns OFF the heater 33 (Step S21), and then finishes the temperature adjustment.

When determining that the printer 1 is in the upright position (Step S13: NO), the CPU 150 selects the second temperature sensor 35 as the temperature sensor used for the temperature adjustment (Step S15), and estimates the surface temperature of the fixing roller 31 by using the detection value of the selected temperature sensor and the correction table stored in the correction table storage 155 (Step S16).

The correction table can be the same as the correction table used for the temperature estimation based on the detection value of the first temperature sensor 34. This is because when the printer 1 is in the upright position, the heat sensitive portion 35*a* of the second temperature sensor 35 is located right above the midpoint of the fixing roller 31 just like the heat sensitive portion 34*a* of the first temperature sensor 34 when the printer 1 is in the horizontal position, and their respective distances from the circumferential surface of the fixing roller 31 are set to be the same.

Therefore, it is unnecessary to prepare different correction tables for the horizontal position and the upright position. Consequently, the required size of the storage for storing the correction table can be reduced.

As described above, the first temperature sensor 34 and the second temperature sensor 35 are heated by thermal conduction due to the natural convection of the air. In the natural convection, the air flows upward. Therefore, when the temperature sensors are displaced from the point right above the midpoint of the fixing roller 31 along the circumferential direction of the fixing roller 31, the heat sensitive portions go out of the main stream of the convection. As a result, the amount of the conducted heat will reduce. In addition, the convection of the air could be unstable.

On the other hand, according to the printer 1 pertaining to the present embodiment, the heat sensitive portion of the temperature sensor selected according to the orientation of the printer 1 is located right above the midpoint of the roller, where is within the main stream of the air convection and is stably supplied with the conductive heat. Therefore, the temperature sensors can stably detect the temperature regardless of the orientation of the printer 1.

(2) Embodiment 2

(2-1) Structure of Image Forming Apparatus

The following describes a printer as an example of an image forming apparatus pertaining to Embodiment 2 of the present invention, with reference to the drawings.

The structure of a printer 200 pertaining to Embodiment 2 is basically similar to the printer 1 pertaining to Embodiment 1 described above, but the printer 200 pertaining to Embodiment 2 is different from the printer 1 in that the printer 200 is not provided with the orientation detector 51 and that only one movable temperature sensor for controlling the temperature of the fixing roller 31 is provided along the outer circumferential surface of the fixing roller 31.

In the following, the same components as Embodiment 1 are given the same reference numbers and their descriptions are omitted, and mainly the differences will be described.

Figure 5:
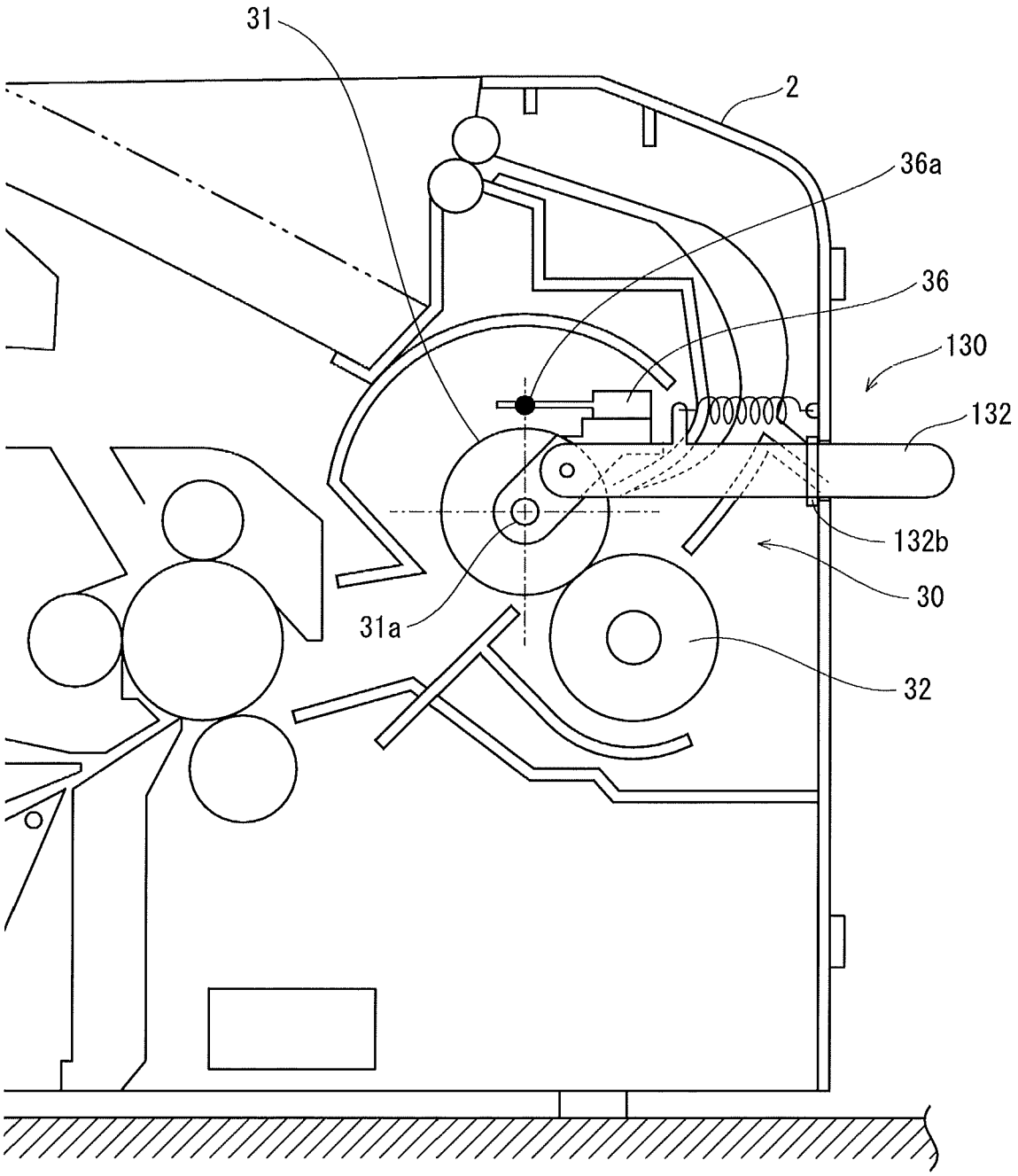
FIG. 5 is a schematic cross-sectional view of an image forming apparatus pertaining to Embodiment 2 of the present invention, orientated in the horizontal position.

FIG. 5 is a schematic cross-sectional view showing primary components included in the fixing unit 30 of the printer 200 pertaining to Embodiment 2 of the present invention. This drawing shows the printer 200 orientated in the horizontal position.

As shown in the drawing, a single temperature sensor, namely a temperature sensor 36, is supported by a supporting mechanism 130. The temperature sensor 36 is used for detecting the temperature of the fixing roller 31.

As with the first temperature sensor 34 and the second temperature sensor 35 of Embodiment 1, the temperature sensor 36 is made up from a relatively cheap thermal sensor such as a thermistor or a thermocouple, and detects the temperature of the conductive heat.

Figure 6:
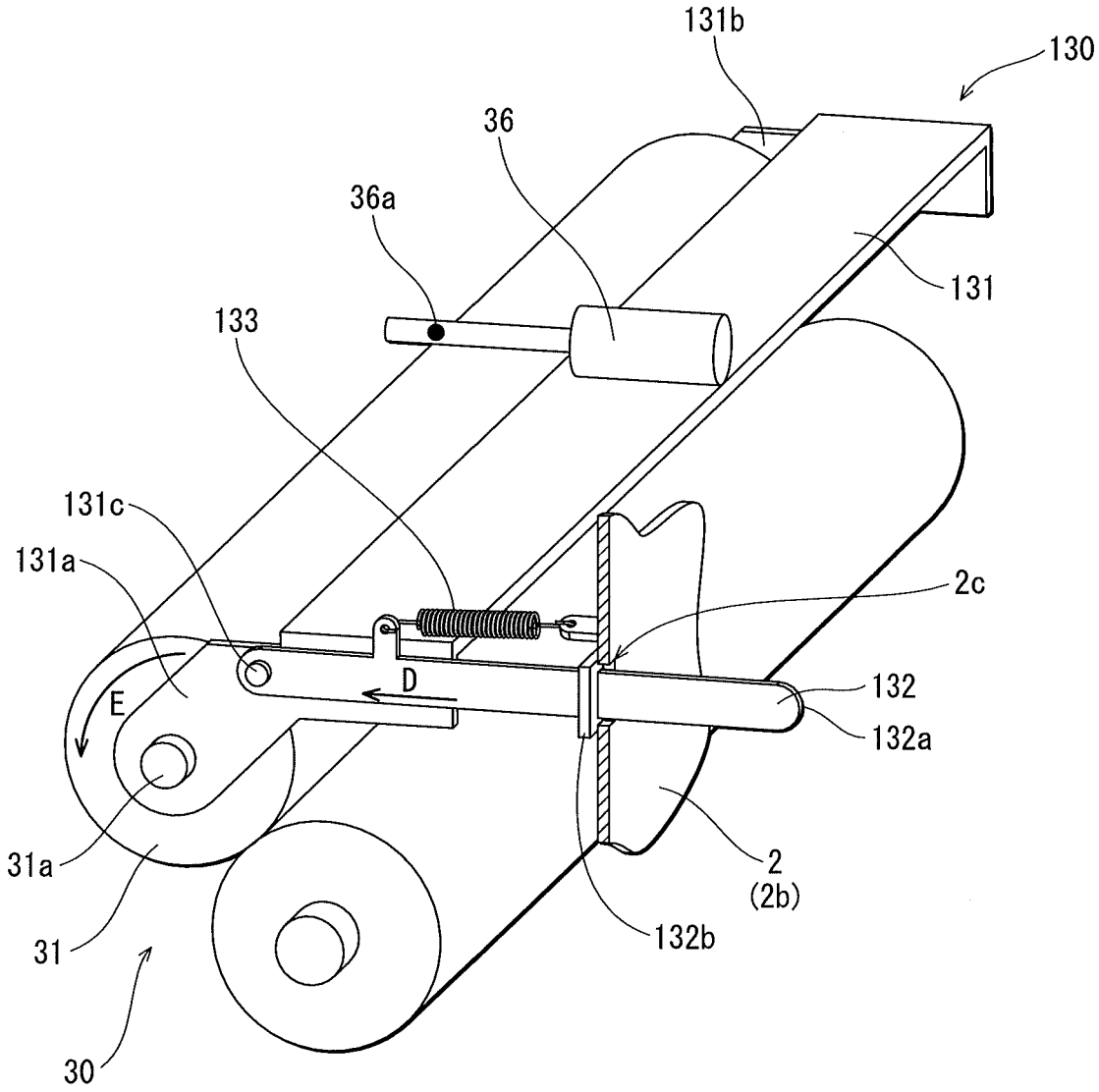
FIG. 6 is a perspective view of a fixing unit and its vicinity of the image forming apparatus pertaining to Embodiment 2.

FIG. 6 is a perspective view illustrating the supporting mechanism 130 of the temperature sensor 36.

As shown in the drawing, the supporting mechanism 130 includes: a supporting member 131 which is arranged in parallel with the fixing roller 31; and side plates 131*a* and 131*b* which are formed by folding both ends of the supporting member 131 by 90°. The side plates 131*a* and 131*b* of the supporting mechanism 130 are attached to a rotational shaft 31*a* of the fixing roller 31 so as to be rotatable about the rotational shaft 31*a*.

The temperature sensor 36 is fixed to the middle area of the supporting member 131 in the longitudinal direction.

Also, a rod 132 is attached to the side plate 131*a* such that an end portion of the rod 132 is rotatable about a pin 131*c* provided at a distance from the rotational shaft 31*a* of the fixing roller 31. The rod 132 and the supporting mechanism 130 constitute a link mechanism.

An end portion 132*a* of the rod 132, which is opposite the end portion supported by the pin 131*c* on the side plate 131*a*, protrudes out of a through hole 2*c* provided in the face 2*b* of the casing 2.

A tension spring 133 is suspended between the rod 132 and the face 2*b* of the casing 2. Hence, the rod 132 is biased by the tension spring 133 to protrude out of the through hole 2*c*.

The rod 132 has a stopper 132*b* like a flange, which is provided in the middle of the rod 132. The stopper 132*b* can be brought into contact with the inner surface of the casing 2. Thus the stopper 132*b* determines the amount of the protrusion of the end portion 132*a* of the rod 132.

When the printer 200 is in the horizontal position, the rod 132 is stopped at the position shown in the drawing. As a result, the heat sensitive portion 36*a* of the temperature sensor 36 fixed to the supporting member 131 comes right above the midpoint of the fixing roller 31 as shown in FIG. 5.

Figure 7:
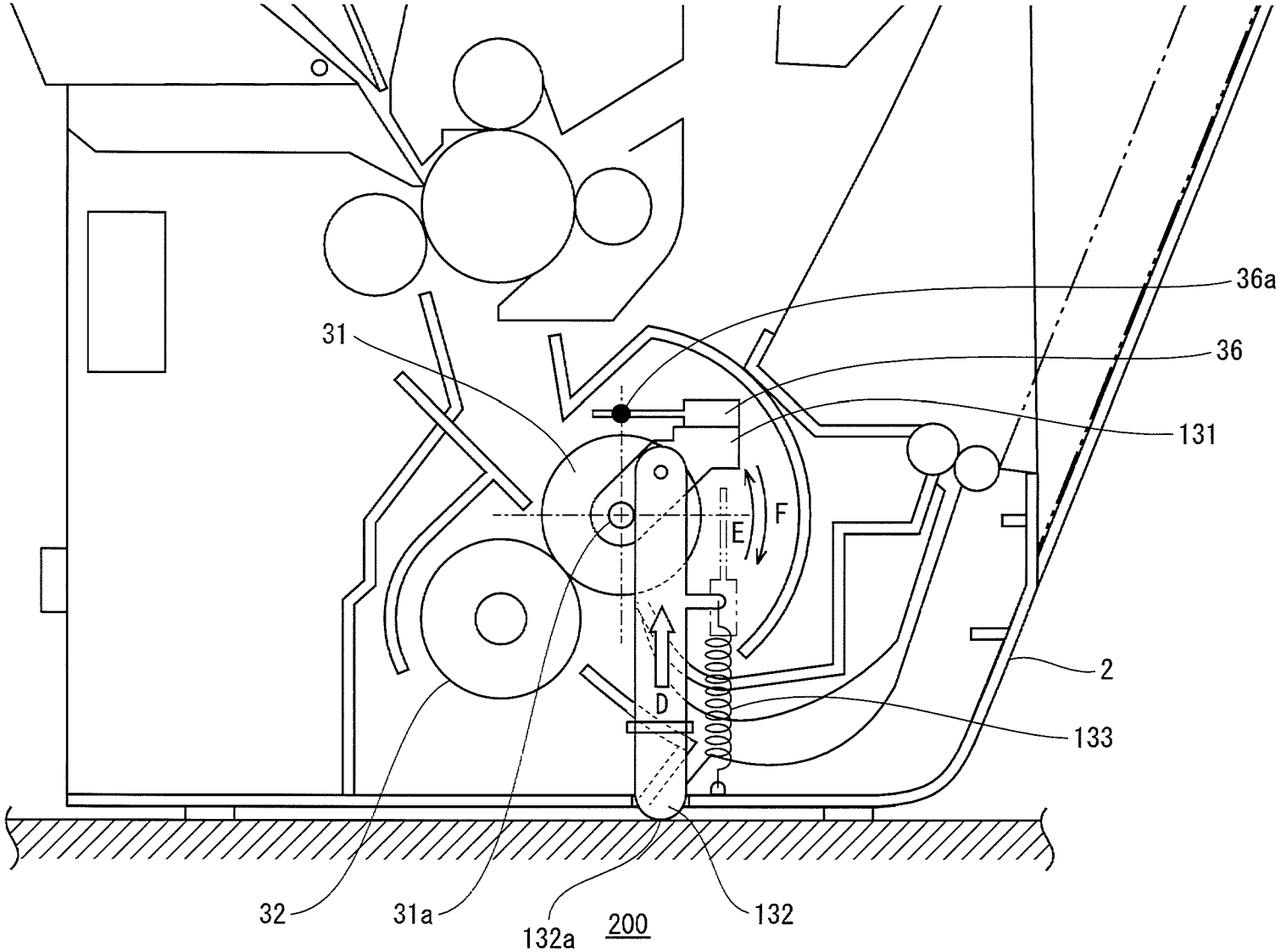
FIG. 7 is a schematic cross-sectional view of the image forming apparatus pertaining to Embodiment 2 of the present invention, orientated in the upright position.

When the orientation of the printer 200 is changed from the horizontal position to the upright position as shown in FIG. 7, the face 2*b* of the casing 2 will be the bottom surface, and the end portion 132*a* of the rod 132 protruding from the face 2*b* is brought into contact with the mounting surface. Thus, the end portion 132*a* is pressed by the mounting surface in the direction indicated by the arrow D, acting against the biasing force of the tension spring 133.

As a result, the supporting member 131 is rotated in the direction indicated by the arrow E, and accordingly the temperature sensor 36 supported by the supporting member 131 moves along the outer circumferential surface of the fixing roller 31.

The sizes and the locations of the above-mentioned parts of the supporting mechanism 130 are designed such that the heat sensitive portion 36*a* of the temperature sensor 36 comes right above the midpoint of the fixing roller 31 when the printer 200 is orientated in the upright position.

As with Embodiment 1, Embodiment 2 satisfies the condition that the minimum distance between the surface of the fixing roller 31 and the heat sensitive portion 36*a* of the temperature sensor 36 is set to be 2.3 mm±0.3 mm regardless of whether the printer 200 is in the horizontal position or in the upright position.

In the printer 200 pertaining to Embodiment 2 having such a structure, the heat sensitive portion 36*a* of the temperature sensor 36 comes right above the midpoint of the roller where is within the main stream of the air convection and is stably supplied with the conductive heat, regardless of whether the printer 200 is in the horizontal position or in the upright position. Therefore, the temperature detected by the temperature sensor 36 will more accurately reflect the surface temperature of the fixing roller 31.

The condition for the heat conduction to the heat sensitive portion 36*a* located right above the midpoint of the roller is substantially the same regardless of the orientation of the printer 200. Thus, it is possible to precisely estimate the surface temperature of the fixing roller 31 by using the same correction table regardless of the orientation.

Therefore, as with the case of Embodiment 1, the required size of the correction table storage 155 for storing the correction table can be reduced.

When the orientation of the printer 200 is changed from the upright position to the horizontal position, the rod 132 protrudes from the casing 2 due to the act of the tension spring 133, since the rod 132 will be released from the pressure by the installation surface which pushes the rod 132 inside the apparatus.

As a result, the supporting member 131 moves backward in the direction indicated by the arrow F, and accordingly the temperature sensor 36 fixed to the supporting member 131 returns to the position indicated by the two-dotted line.

As described above, the heat sensitive portion 36*a* of the temperature sensor 36 included in the Embodiment 2 is located at the position right above the midpoint of the roller, where is within the main stream of the air convection, regardless of the orientation of the printer 200. Since the condition for the heat conduction to the heat sensitive portion 36*a* located right above the midpoint of the roller is the same regardless of the orientation of the printer 200, it is possible to precisely estimate the surface temperature of the fixing roller 31 by using a same correction table.

<Modifications>

The present invention is not limited to the embodiments described above. The following modifications may be adopted.

(1) According to Embodiments 1 and 2 described above, the heat sensitive portion of the temperature sensor for the temperature adjustment is located right above the midpoint of the roller regardless of the orientation of the printer. However, the present invention is not limited this.

Figure 8B:
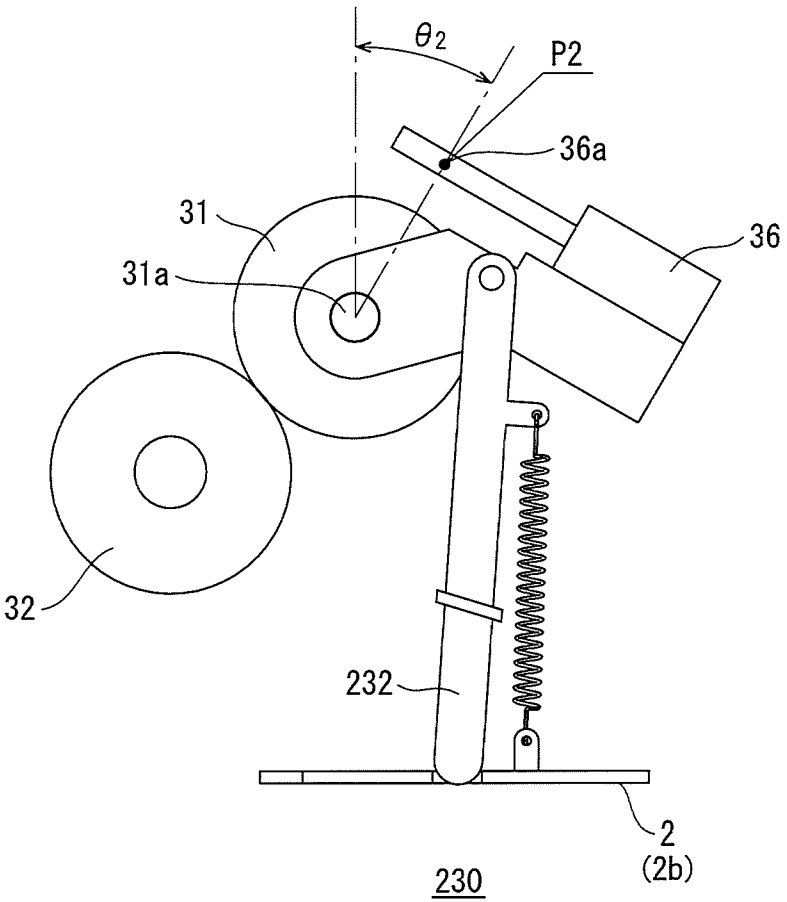
FIG. 8A and FIG. 8B are side views showing a fixing unit and its vicinity of an image forming apparatus pertaining to a modification of the present invention.
Figure 8A:
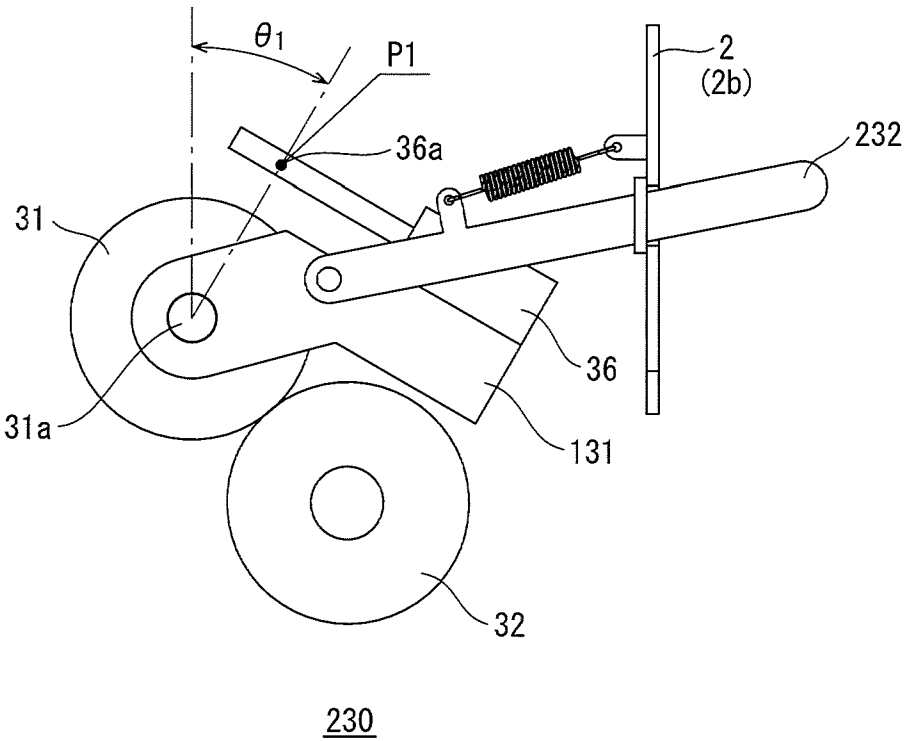

FIG. 8A and FIG. 8B show the structure of a supporting mechanism 230 pertaining to the present modification.

FIG. 8A shows the supporting mechanism 230 under the condition that the printer is in the horizontal position, and FIG. 8B shows the supporting mechanism 230 under the condition that the printer is in the upright position.

The structure of the supporting mechanism 230 pertaining to the present modification is basically similar to the structure of the supporting mechanism 130 pertaining to Embodiment 2. However, the supporting mechanism 230 is different from the supporting mechanism 130 in the location of the temperature sensor 36 relative to the fixing roller 31 and the rotational angle at the time the orientation of the printer is changed.

In the case of the supporting mechanism 230, when the printer is in the horizontal position, the heat sensitive portion 36*a* of the temperature sensor 36 is located at the point P1 shown in FIG. 8A. The point P1 is a point on the line that is tilted clockwise by an angle θ1 from the vertical line passing through the widthwise midpoint of the fixing roller 31. When the printer is in the upright position, the heat sensitive portion 36*a* of the temperature sensor 36 is located at the point P2 shown in FIG. 8B. The point P2 is a point on the line that is tilted clockwise by an angle θ2 from the vertical line passing through the widthwise midpoint of the fixing roller 31. The angle θ1 is substantially the same as the angle θ2.

With such a structure, the position of the heat sensitive portion 36*a* relative to the point right above the midpoint of the roller is the same regardless of whether the printer is in the horizontal position or in the upright position.

Therefore, the condition for the heat conduction to the heat sensitive portion 36*a* due to the natural convection of the air around the heat sensitive portion 36*a* is substantially the same regardless of the orientation of the printer. Thus, it is possible to precisely estimate the surface temperature of the fixing roller 31 by using a same correction table.

The same concept can be adopted in the case where one temperature sensor is provided for each orientation of the printer, like the case of the fixing unit 30 pertaining to Embodiment 1. In such a case, the heat sensitive portion 34*a* of the first temperature sensor 34 and the heat sensitive portion 35*a* of the second temperature sensor 35 are located at the point P1 and the P2. With such a structure, as with the structure of the modification described above, it is possible to precisely estimate the surface temperature of the fixing roller 31 by using a same correction table regardless of the orientation.

Note that the angle θ1 and the angle θ2 are not necessarily exactly the same. Even if there is a difference between the angles, it is acceptable providing that the difference between the value detected by one sensor when the printer is in one of the positions and the value detected by the other sensor when the printer is in the other position both falls within a predetermined range (e.g. ±15%). This is because such a difference does not lead to a significant difference in accuracy of the temperature adjustment even when a same correction table is used.

Note that the accuracy of detecting the surface temperature of the fixing roller 31 by using the natural convection will be degraded if the angles θ1 and θ2 are too large. Therefore, it is preferable that both angles are smaller than 90°, more preferably smaller than 45°.

(2) In the Embodiments described above, the correction table storage 155 stores a correction table for estimating the surface temperature of the fixing roller 31 based on the output from the first temperature sensor 34 when the printer is in the horizontal position.

However, the correction table storage 155 may store more rigorous correction table for improvement in accuracy of the temperature detection by the fixing roller 31.

Strictly saying, the value output by the temperature sensor is under the influence of both the heat conducted from the surface of the fixing roller 31 due to the air convection and the temperature within the housing of the fixing unit 30 (hereinafter referred to as "the atmospheric temperature").

Therefore, the difference between the actual surface temperature of the fixing roller 31 and the detected value of the temperature sensor slightly changes according to the atmospheric temperature around the fixing unit 30 at the beginning of the temperature adjustment.

That is, although the value detected by the temperature sensor correctly reflects the surface temperature of the fixing roller 31 when the atmospheric temperature is low, a high atmospheric temperature has a great influence on the value detected by the temperature sensor, and raises the need to modify the correction coefficient.

Considering this fact, the surface temperature of the fixing roller 31 can be more accurately estimated by: providing a temperature sensor for detecting the atmospheric temperature (hereinafter referred to as "the atmospheric temperature sensor") located away from the fixing roller 31, in addition to the temperature sensor for detecting mainly the surface temperature of the fixing roller 31 (hereinafter referred to as "the temperature sensor for the temperature adjustment") used for the temperature adjustment; preparing a plurality of correction tables each showing correction coefficients for a given atmospheric temperature, and storing the tables in the correction table storage 155. At the temperature adjustment, one of the correction table is selected according to the detection value of the atmospheric temperature sensor, and the selected correction table is used for correcting the value detected by the temperature sensor for the temperature adjustment.

If various correction tables are prepared for each orientation of the printer, the required size of the storage for storing the correction tables increases. However, as described above, the present invention can use the same correction tables for each orientation of the printer, and thereby reduces the required size of the storage.

(3) In Embodiment 1 described above, the orientation detector 51 is used for obtaining the orientation of the printer 1. However, the present invention is not limited to such a structure.

For example, the orientation of the printer 1 may be specified by the user. For example, the user may input an instruction specifying the orientation of the printer 1 from the operation panel (not illustrated) of the printer 1, or operating a manual switch or the like. Alternatively, the orientation of the printer 1 may be detected by using an inclination sensor or an acceleration sensor, instead of the push switch described above. Inclination sensors and acceleration sensors detect the direction of the acceleration due to gravity.

(4) In Embodiments 1 and 2 described above, the fixing roller 31 is applied heat by the heater 33 built in the fixing roller 31. However, the present invention is not limited to such a structure.

In recent years, so called loose-fitting fixing devices have been developed. In such a fixing device, no heater is built in the fixing roller. Instead, the roller is loosely inserted in an endless fixing belt including a heating layer having an inside diameter that is slightly larger than the outer diameter of the roller. The heating layer of the fixing belt is inductively heated.

This structure is advantageous in its capability of reducing the warming up time due to a high heat-insulating efficiency, since only part of the outer circumferential surface of the fixing belt is brought into contact with the outer circumferential surface of the roller.

When the loose-fitting fixing device is adopted, the subject of the temperature detection is not the fixing roller, but the fixing belt. As described above, any component that can serve as the heating roller may be the subject of the temperature detection.

(5) In Embodiments 1 and 2 described above, when changing the orientation of the printer from the horizontal position to the upright position by rotating the printer, the rotational angle is 90° since the face 2*a* and the face 2*b* are perpendicular to each other. However, the present invention is not limited to such a structure.

For example, the angle formed by the face 2*a* and the face 2*b* can be not 90°. If this is the case, the rotational angle when changing the orientation of the printer from the horizontal position to the upright position is different from 90°.

When such a structure is adopted in Embodiment 1, it is preferable that both heat sensitive portions 34*a* and 35*a* will be located right above the midpoint of the roller when the printer is in the horizontal position and in the upright position, respectively.

Similarly, when the structure is adopted in Embodiment 2, it is preferable that the position of the heat sensitive portion 34*a* of the temperature sensor 134 is changed to the position right above the midpoint of the roller according to the orientation of the printer.

(6) In Embodiments 1 and 2 described above, the fixing roller and the pressure roller are press against each other in order to form the fixing nip. However, the present invention is not limited to such a structure.

For example, instead of the pressure roller, a pressure pad whose surface is covered with low friction material or the like may be pressed against the fixing roller. That is, any component may be adopted providing that it is slidable on the surface of the fixing roller while applying pressure to the fixing roller.

(7) Embodiments above exemplify the cases where an image forming apparatus pertaining to the present invention is applied to a monochrome printer. However, the present invention may be applied to a tandem color digital printer. That is, the present invention is generally applicable to any image forming apparatus that is orientatable in different positions and provided with a fixing device having a heating roller.

Also, the present invention may be any combinations of the Embodiments and Modifications described above.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus that is orientatable in either a first position or a second position, the second position being different from the first position in inclination with respect to a horizontal plane, comprising:

a fixing device that includes a heating roller and a pressurizing member, presses the pressurizing member against a surface of the heating roller to form a fixing nip, and thermally fixes a toner image formed on a recording sheet passing through the fixing nip;

at least one temperature detector that detects temperature of the surface of the heating roller without contact with the surface;

a heater that heats the heating roller;

a controller that controls the heater according to the temperature detected by the at least one temperature detector, and thereby controls the temperature of the surface of the heating roller; and a switcher that switches a detection point of the at least one temperature detector between a first detection point and a second detection point according to whether the image forming apparatus is in the first position or in the second position;

wherein the switcher serves as a movement mechanism that moves the at least one temperature detector according to whether the image forming apparatus is in the first position or in the second position.

2. The image forming apparatus of claim 1, wherein the switcher includes:

a supporting member that supports and moves the at least one temperature detector; and a movable protruding member that protrudes from a side of a casing of the image forming apparatus when the image forming apparatus is in the first position, and becomes embedded in the casing by being pressed by an installation surface when the image forming apparatus is in the second position, the installation surface being a surface on which the image forming apparatus is installed, and the switcher serves as a link mechanism that converts movement of the protruding member into a force of moving the supporting member and transmits the force to the supporting member, by which the supporting member moves the at least one temperature detector.

3. The image forming apparatus of claim 2, wherein when the orientation of the image forming apparatus is changed from the second position to the first position, the protruding member protrudes from the casing and causes the temperature detector to move from the second detection point to the first detection point.

4. The image forming apparatus of claim 2 further comprising:

a storage that stores therein a correction table, the correction table being for correcting a detection value of the temperature of the surface of the heating roller obtained by the temperature detector, and being applicable to both the first position and the second position; and a corrector that corrects, with respect to each of the first position and the second position, the detection value of the temperature of the surface of the heating roller according to information read from the correction table stored in the storage.

* * * * *